US006227656B1

(12) United States Patent
Shibata et al.

(10) Patent No.: US 6,227,656 B1
(45) Date of Patent: May 8, 2001

(54) DEPOSITING CHARGED PARTICLES ONTO A SHEET BASED ON DISTANCES RELATIVE TO A PRINT HEAD

(75) Inventors: Yoshifumi Shibata, Toyokawa; Toshio Yamaki, Takatsuki; Hirokatsu Shimada, Machida; Koji Uno, Kobe; Hiroshi Hiraguchi, Toyokama, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/158,814

(22) Filed: Sep. 22, 1998

(30) Foreign Application Priority Data

Jul. 3, 1998 (JP) ..... 9-258920

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 293, 294, 295

(56) References Cited

U.S. PATENT DOCUMENTS

| | | | | |
|---|---|---|---|---|
| 5,477,250 | | 12/1995 | Larson | 347/55 |
| 5,880,760 | * | 8/2000 | Desie et al. | 347/55 |
| 6,109,730 | * | 8/2000 | Nilsson et al. | 347/55 |

* cited by examiner

*Primary Examiner*—John Barlow
*Assistant Examiner*—Raquel Yvette Gordon
(74) *Attorney, Agent, or Firm*—Morrison & Foerster LLP

(57) ABSTRACT

A print head 50 comprises an insulative sheet member 52 that includes a plurality of apertures 56 arranged in rows. Arranged adjacent to each aperture 56 are first and second electrodes 68 and 70. The first electrode 68 is communicated with a driver 72 while the second electrode 70 is communicated with a driver 76 or 80. By applying first and second pulsating signals with the first and second electrodes, respectively, printing particles on a portion of bearing member 30 that opposes to the electrodes are energized to propel into corresponding aperture. A voltage and/or duration of the pulsating signal is determined according to the distance between the portion of the bearing member and the opposing aperture. Thereby, almost the same amount of printing particles are propelled into each aperture to form the same size dots on the sheet substrate 8.

4 Claims, 9 Drawing Sheets

Fig.6A
IMAGE SIGNAL 84
Fig.6B
IMAGE SIGNAL 86
Fig.6C
IMAGE SIGNAL 88
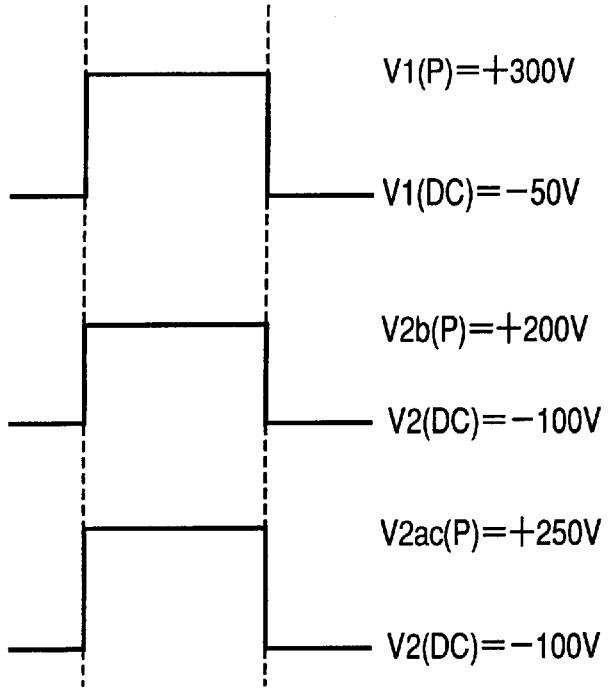
Fig.7
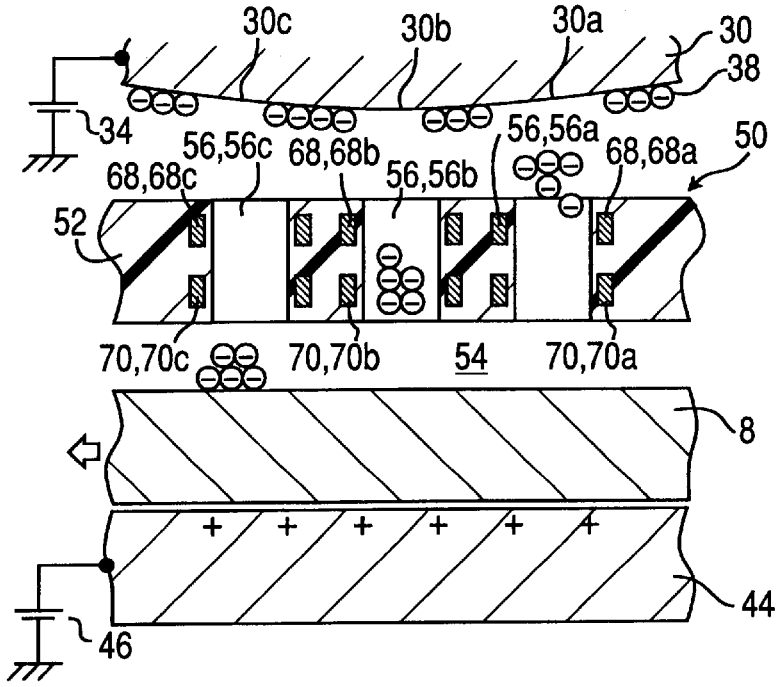

Fig.8A
IMAGE SIGNAL 86
Fig.8B
IMAGE SIGNAL 88
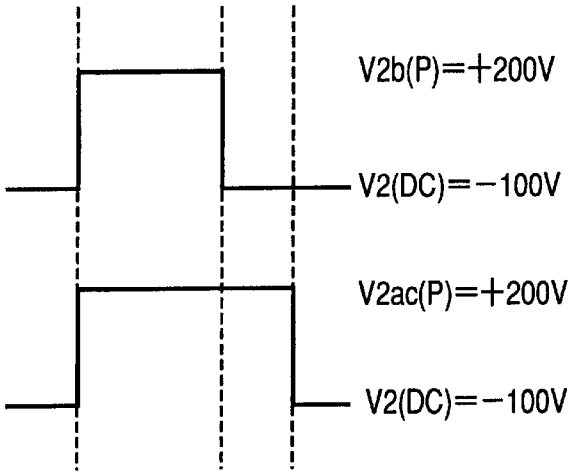
Fig.9A
IMAGE SIGNAL FOR ELECTRODE 68b
Fig.9B
IMAGE SIGNAL FOR ELECTRODE 68a,68c
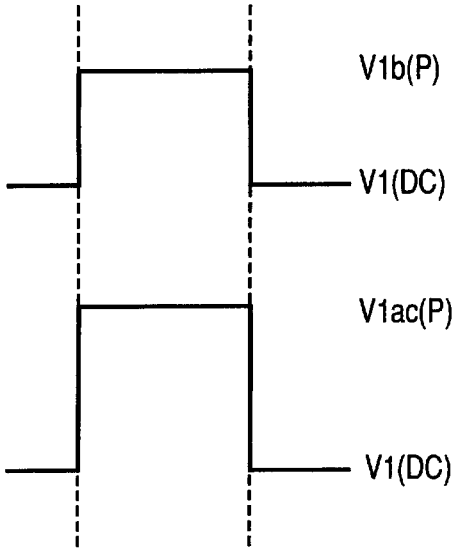
Fig.10A
IMAGE SIGNAL FOR ELECTRODE 68b
Fig.10B
IMAGE SIGNAL FOR ELECTRODE 68a,68c
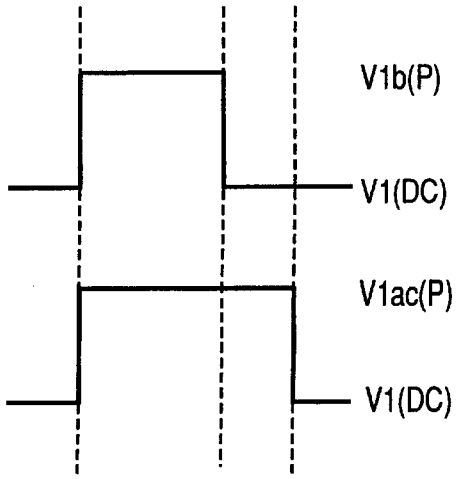

DEPOSITING CHARGED PARTICLES ONTO A SHEET BASED ON DISTANCES RELATIVE TO A PRINT HEAD

FIELD OF THE INVENTION

The invention relates to a direct printing apparatus in which an electrically charged printing material of particles is deposited on a sheet substrate to form an image on the sheet substrate.

BACKGROUND OF THE INVENTION

U.S. Pat. No. 5,477,250 issued on Dec. 19, 1995 discloses a direct printing apparatus. The direct printing apparatus includes a rotatable cylinder or toner carrier, which retains electrically charged toner or printing particles on its outer periphery, and a backing electrode spaced apart from the toner carrier. The backing electrode is electrically connected to a power source, thereby forming an electric field that attracts the charged toner particles on the toner carrier toward the backing electrode. Interposed between the toner carrier and the backing electrode is an insulative plate that includes a plurality of apertures through which the toner particles can pass. A pair of signal and base electrodes surrounds each aperture. The signal electrode is mounted on one surface, adjacent to the backing electrode, of the insulative plate and the base electrode is mounted on the other surface, adjacent to the toner carrier, of the insulative plate.

With the direct printing apparatus, when an image signal is applied to the signal and base electrodes, the toner particles on the toner carrier, opposing to those electrodes, are energized and then propelled through associated apertures onto the sheet substrate, forming an image corresponding to the image signal on the sheet substrate.

An amount of toner particles being energized and then propelled depends upon the Coulomb's force that is inversely proportional to the square of the distance between the toner carrier and backing electrode. When a rotatable cylindrical member is employed as the toner carrier, due to its curvature, a distance between one portion of the cylindrical member and the backing electrode is different from a distance between another portion of the cylindrical member, spaced away in a peripheral direction from the one portion and the backing electrode. This results in that the amount of toner particles moving into the aperture in a closest region where a distance between the toner carrier and the backing electrode is minimized differs from the that moving into another aperture in another region spaced away in a rotational direction of the cylindrical member from the closest region, thereby degrading a quality of the resultant image.

Likewise, if a distance between one end of the cylindrical member and the backing electrode (or the insulative plate) is different from that between the opposite end of the cylindrical member and the backing electrode (or the insulative plate), a density of an image formed at or adjacent to one end of the cylindrical member is not identical to that formed at or adjacent to the other end of the cylindrical member, further degrading the quality of the resultant image.

SUMMARY OF THE INVENTION

The primary object of the present invention is to provide a direct printing apparatus capable of propelling a certain amount of printing material through each aperture.

Another object of the present invention is to provide a direct printing apparatus capable of eliminating a difference of densities of images formed on opposite sides.

For purposes, a direct printing apparatus of the present invention has a bearing member which bears the printing particles thereon, the printing particles being electrically charged to a certain polarity, a backing electrode which opposes to the bearing member, and a power supply which generates an electric field that attracts the charged printing particles born on the bearing member toward the backing electrode. The printing device also includes a printing head that interposes between the bearing member and the backing electrode to cooperate with the backing electrode, thereby forming a passage therebetween through which passage the sheet substrate such as plain paper can pass. The printing head has an electrically insulative sheet member having a plurality of apertures arranged in one or more lines through each of the apertures the printing particles can propel, and a plurality pairs of first and second electrodes, each pair of first and second electrodes being arranged adjacent to the aperture. Each pair of first and second electrodes are connected with a driver which applies the pair of first and second electrodes with first and second pulsating signals, respectively, thereby energizing the printing particles born on the opposing portions of the bearing member to propel the energized printing particles into associated aperture. A voltage level and/or a duration of the second pulsating signal to be applied to the second electrode is determined by a distance between the aperture adjacent to which the second electrode is arranged and an associated portion of the bearing member that opposes to the aperture. This ensures that the same amount of printing particles are propelled through each aperture and then deposited onto the sheet substrate moving past between the printing head and the backing electrode.

Preferably, the first electrode is located on one side, adjacent to the bearing member, of the printing head and the second electrode is located on the other side, adjacent to the backing electrode, of the printing head.

In another aspect of the present invention, a direct printing apparatus has such bearing member, backing electrode and power supply. Also, the printing apparatus includes a printing head having an insulative sheet member that interposes between the bearing member and the backing electrode to cooperate with the backing electrode to form a passage therebetween through which passage the sheet substrate can pass. The insulative sheet member is formed of a plurality of apertures arranged in one or more lines through each of the aperture the printing particles can propel. Also, the insulative sheet member has a plurality of electrodes. Each electrode is arranged adjacent to the aperture and is sized or spaced away from the aperture according to a distance between the aperture adjacent to which the electrode is arranged and an associated portion of the bearing member that opposes to the aperture.

According to the direct printing apparatus of the present invention, depending upon the distance between the aperture and the bearing member, the voltage level and/or the duration of the second pulsating signal to be applied to the second electrode, the size of the electrode, or the distance between the electrode and the associated aperture is determined, so that the same amount of printing particles are propelled through each aperture and then deposited onto the sheet substrate. This ensures that dots formed on the sheet substrate have the same size, forming a high quality image.

BRIEF DESCRIPTION OF THE DRAWINGS

The present invention will be further described with reference to the accompanying drawings wherein like reference numerals refer to like parts in the several views, and wherein:

FIG. 6A is a voltage waveform of an image signal applied to the first electrode;

FIG. 6B is a voltage waveform of an image signal applied to the second electrode in the central portion;

FIG. 6C is a voltage waveform of an image signal applied to the second electrode in the upstream and downstream sides;

FIG. 7 is a is an enlarged fragmentary cross-sectional view of the printing head, developing roller and backing electrode taken along a line IV—IV in FIG. 3 in which toner particles on the developing roller are propelled into the aperture;

FIG. 8A is a voltage waveform of another image signal applied to the second electrode in the central portion;

FIG. 8B is a voltage waveform of an image signal applied to the second electrode in the upstream and downstream sides;

FIG. 9A is a voltage waveform of another image signal applied to the first electrode in the central portion;

FIG. 9B is a voltage waveform of an image signal applied to the first electrode in the upstream and downstream sides;

FIG. 10A is a voltage waveform of another image signal applied to the first electrode in the central portion;

FIG. 10B is a voltage waveform of an image signal applied to the first electrode in the upstream and downstream sides;

DETAILED DESCRIPTION OF THE PREFERRED EMBODIMENTS

Figure 1:
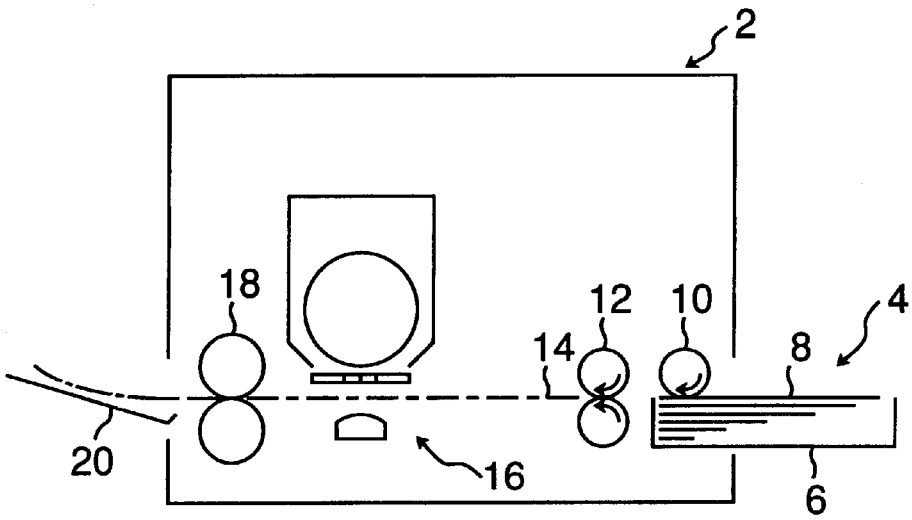
FIG. 1 is a schematic cross-sectional side elevational view of a printing device of the present invention.

With reference to the drawings and, in particular, to FIG. 1, there is shown a direct printing device, generally indicated by reference numeral 2, according to the present invention. The printing device 2 has a sheet feed station generally indicated by reference numeral 4. The sheet feed station 4 includes a cassette 6 in which a number of sheets 8 or plain papers are stacked. A sheet feed roller 10 is mounted for rotation above the cassette 6 so that it can frictionally contact with the top sheet 8, thereby the feed roller 10 can feed the top sheet 8 into the direct printing device 2 as it rotates. A pair of timing rollers 12 are arranged adjacent to the sheet feed roller 10, for supplying the sheet 8 fed from the cassette 6 through a sheet passage 14 indicated by a dotted line into a printing station, generally indicated by reference numeral 16, where a printing material is deposited on the sheet to form an image thereon. Further, the printing device 2 includes a fusing station 18 for fusing and permanently fixing the image of printing material on the sheet 8, and a final stack station 20 for catching the sheets 8 on which the image has been fixed.

Figure 2:
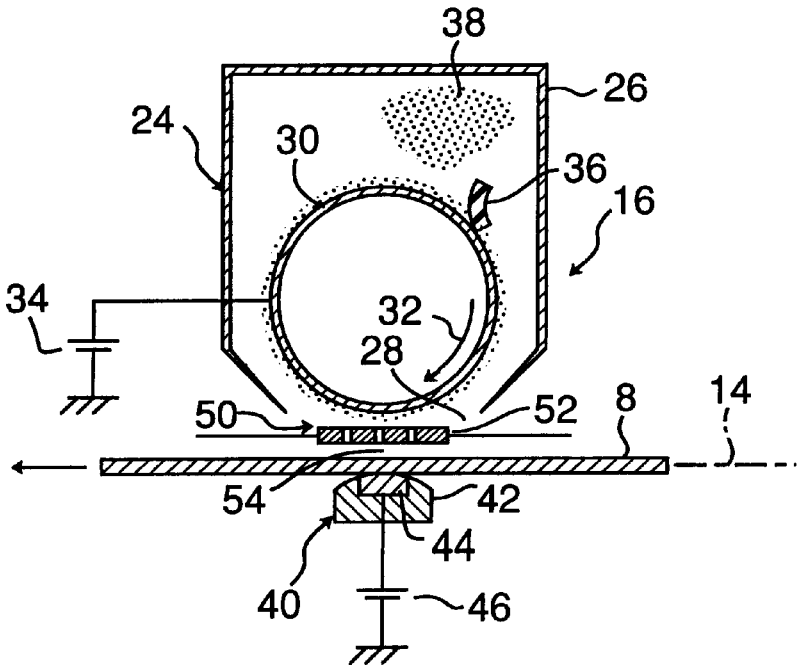
FIG. 2 is a cross-sectional side elevational view of a printing station mounted in the printing device shown in FIG. 1.

Referring to FIG. 2, the printing station 16 has a developing device, generally indicated by reference numeral 24, above the sheet passage 14. The developing device 24 includes a container 26 having an opening 28 confronting to the sheet passage 14. Adjacent to the opening 28, a developing roller 30 is supported for rotation in a direction indicated by an arrow 32. The developing roller 30 is made of conductive material and is electrically connected to a DC power source 34. A blade 36, preferably made from a plate of elastic material such as rubber or stainless steel, is arranged in contact with the developer roller 30.

The container 26 accommodates a printing material, i.e., toner particles 38. The toner particles 38 are supplied onto an outer peripheral surface of the developer roller 30 and then transported by the rotation of the developer roller 30. The toner particles 38 retained on the developer roller 30 is then transported into a contact region between the developer roller 30 and the blade 36, where they are brought into frictional contact with the blade 36 and, thereby, charged with a certain polarity. In this embodiment, used are the toner particles capable of being charged with negative polarity by the contact with the blade 36. Therefore, each of incremental outer peripheral portions of developer roller 30, moved past the contact region between the developer roller 30 and the blade 36, bears a thin layer of negatively charged toner particles 38. Also, as shown in drawing, the developing roller 30 is supplied with a positive voltage from the power source 34, thereby electrically attracting and retaining the negatively charged toner particles on the developer roller 30.

An electrode mechanism, generally indicated by reference numeral 40, is arranged under the developing device 24 and further under the sheet passage 14. The electrode mechanism 40 includes a support 42 made of electrically insulative material and a backing electrode 44 made of electrically conductive material and supported by the support 42. The backing electrode 44 is electrically connected to a power supply 46 so that it can be provided with a voltage of certain polarity, i.e., positive polarity in this embodiment, thereby electrically attracting the negatively charged toner particles 38 on the developer roller 30 toward the backing electrode 44.

A printing head, generally indicated by reference numeral 50, is secured between the developing device 24 and the electrode 44 with leaving respective gaps from the developing device 24 and the electrode mechanism 40. Preferably, the printing head 50 is made from a flexible printed circuit board 52, having a thickness of about 100 to 200 $\mu$m. The gap, i.e., printing zone 54, between the printing head 50 and the electrode 44 is dimensioned so that the sheet 8 can pass through the printing zone 54 without any contact with the printing head 50 but in contact with the backing electrode 44.

Figure 4:
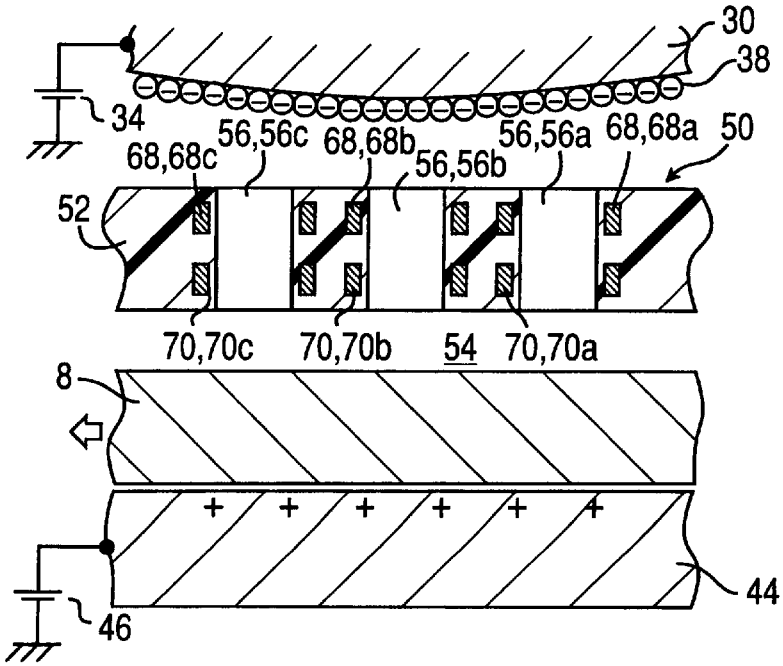
FIG. 4 is an enlarged fragmentary cross-sectional view of the printing head, developing roller and backing electrode taken along a line IV—IV in FIG. 3 in which toner particles on the developing roller are not energized.

As best shown in FIG. 4, a portion of the printing head 50, located in the printing zone 54 where the developer roller 30 confronts the backing electrode 44, includes a plurality of apertures 56, each of which aperture has an inner diameter of about 25 to 200 $\mu$m which is substantially larger than an average outer diameter of the toner particles 38, i.e., about several to a dozen micro-meters.

Figure 3:
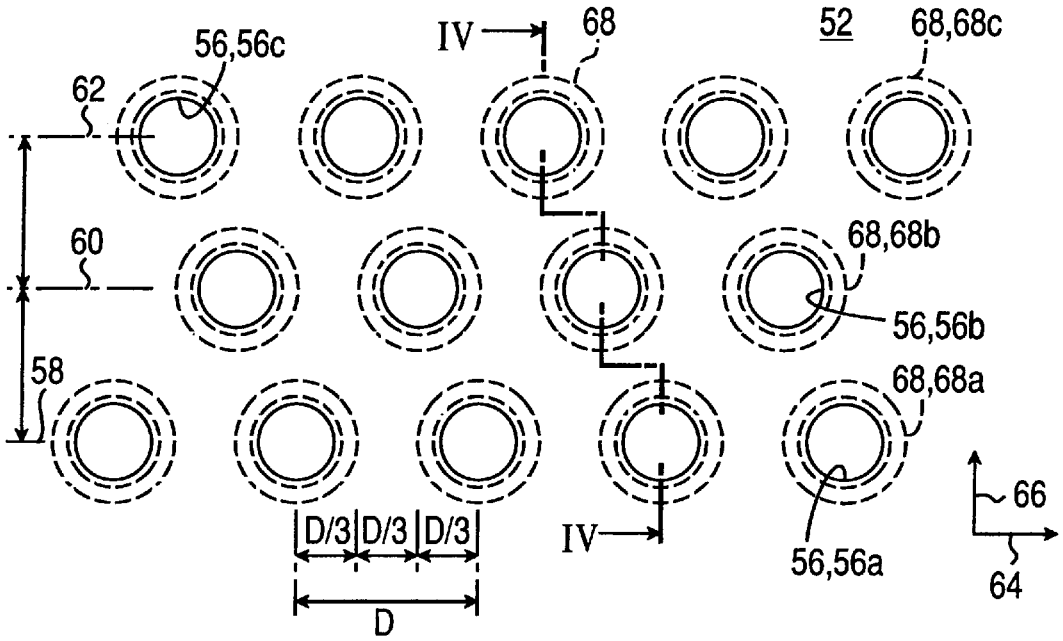
FIG. 3 is an enlarged fragmentary plan view of a print head mounted in the printing device shown in FIG. 1.

As best shown in FIG. 3, in this embodiment the apertures 56 are arranged on equally spaced three parallel lines 58, 60 and 62, each of which lines extending in a certain direction indicated by reference numeral 64. The direction 64 is parallel to a longitudinal axis of the developer roller 30 and perpendicular to a direction indicated by reference numeral 66 along which the sheet 8 is transported. This ensures that the printing head 50 has a resolution of 600 dpi.

The printing head 50 is arranged so that the central line 60 lies on a line along which the lowermost portion of the developer roller 30 confronts to the backing electrode 44 while the lines 58 and 62 lie on downstream and upstream sides, respectively, of the central line with respect to the sheet transporting direction 66.

The apertures 56 on lines 58, 60 and 62 are spaced at a regular interval of D, e.g., 127 $\mu$m. Also, the apertures, 56(56*a*) and 56(56*c*), on the lines 58 and 62, respectively, are shifted by a distance D/N to the opposite directions, i.e., direction 64 and its reverse direction, with respect the corresponding apertures 56(56*b*) on the central line 60. This ensures that, when viewed from the sheet transporting direction 66, the apertures 56 appear to be equally spaced in the direction 64 as a whole. Note that the number N represents the number of lines. Although the number N is set to be "3" in this embodiment, it may be determined depending upon the required resolution of the print head.

The flexible printed circuit board 52 further includes therein a number of pairs of first and associated second electrodes 68 (68*a*, 68*b*, 68*c*) and 70 (70*a*, 70*b*, 70*c*) so that each pair of the first and second electrodes, 68 and 70 (68*a* and 70*a*, 68*b* and 70*b*, 68*c* and 70*c*) surrounds the associated aperture 56 (56*a*, 56*b*, 56*c*). Preferably, the first and second electrodes 68 and 70 are in the form of doughnut. The first electrode 68 is disposed on one side opposing the developer roller 30 while the second electrode 70 is on the other side opposing the backing electrode 44.

Figure 5:
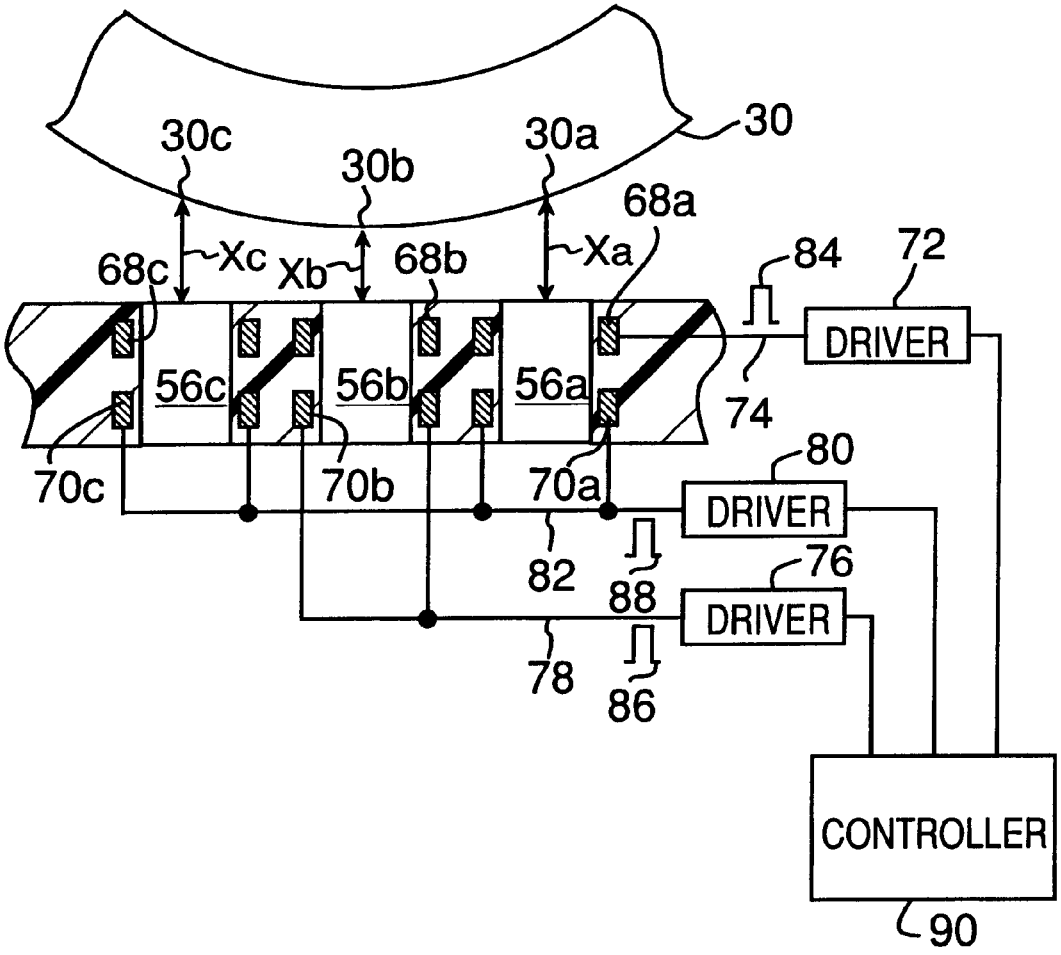
FIG. 5 is an enlarged fragmentary cross-sectional view of the printing head, developing roller and backing electrode, showing electrical connections between electrodes and drivers.

Referring to FIG. 5, the first electrodes 68 (68*a*, 68*b*, 68*c*) are communicated with a driver 72 through a printed wire 74. Further, the second electrodes 70*b* surrounding the central apertures 56*b* are communicated with a driver through a printed wire 78 while the second electrodes 70*a* and 70*c* surrounding the downstream and upstream apertures, respectively, are communicated with a driver 80 through a printed wire 82. This permits the first and second electrodes, 68(68*a*, 68*b* and 68*c*) and 70(70*a*, 70*b* and 70*c*), to be provided with different image signals 84, 86 and 88, which correspond to an image, i.e., dots, to be deposited on the sheet 8. In addition, the drivers 72, 76 and 80 are communicated with a controller 82. This connection permits that the controller 90 supplies respective drivers 72, 76 and 80 with data of image to be printed by the printing device 2 and, in turn, the drivers 72, 76 and 80 output image signals which correspond to the image data.

FIG. 6A shows a part of pulsating voltage waveform of an image signal 84 to be transmitted from the driver 72 to the first electrodes 68. The voltage waveform 82 is a composite voltage in which pulses are superimposed on a DC voltage. The pulses are applied only at ejecting toner particles 38 to form dots on the sheet 8 in response to the image data. Also, FIG. 6B shows a part of pulsating voltage waveform 84 of the image signal 86 to be transmitted from the driver 76 to the second electrodes 70*b* which surround the central apertures 56*b*. Further, FIG. 6C shows a part of pulsating voltage waveform 86 of the image signal 88 to be transmitted from the driver 80 to the downstream and upstream electrodes 70*a* and 70*c*, respectively. The waveforms of the image signals 86 and 88 are also composite voltages, each of which composite voltages includes pulses and the DC voltage. The pulses are also applied only at ejecting toner particles 38 to form dots on the sheet 8 in response to the image data.

Specifically, the pulsating voltage waveform (image signal 84) applied to the first electrode 68 is designed to have a peak level or voltage V1(P) of +300 volts and a resting level or DC voltage V1(DC) of −50 volts. In contrast to this, the pulsating voltage waveform for the central electrode 70*b* is designed to have a peak level or voltage V2*b*(P) of +200 volts and a resting level or DC voltage V2*b*(DC) of −100 volts, and the pulsating voltage waveform for the downstream and upstream electrodes 70*a* and 70*c* are designed to have a greater peak level or voltage V2*ac*(P) of +250 volts and a resting level or DC voltage of V2*ac*(DC) of −100 volts.

The peak voltages V2*b*(P) and V2*ac*(P) are determined so that a difference of the amounts of toner particles to be propelled into the central aperture 56*b* and downstream and upstream apertures 56*a* and 56*c* can be minimized to zero, which difference would be caused by the difference between a distance Xb (see FIG. 5) from the aperture 56*b* to the opposing lowermost portion 30*b* of the developing roller 30 and distance Xa, Xc (Xa=Xc) (also see FIG. 5) between the apertures from 56*a* and 56*c* and the portions 30*a* and 30*c*, respectively. This ensures that the same amount of toner particles 38 are energized at portions 30*a*, 30*b* and 30*c* and propelled into the respective opposing apertures 56*a*, 56*b* and 56*c*.

Having described the construction of the printing device 2, its operation will now be described. As shown in FIG. 2, the developer roller 30 rotates in the direction indicated by the arrow 32. The toner particles 38 are supplied onto the developer roller 30 and then transported by the rotation of the developer roller 30 into a contact region between the blade 36 and the developer roller 30. In the contact region, the toner particles 38 are provided with triboelectric negative charge by the frictional contact of the blade 36. Thereby, as shown in FIG. 4, incremental peripheral portions of the developer roller 30 each of which have passed through the contact region bear a thin layer of electrically charged toner particles 38.

In a waiting state or non-printing state, the first and second electrodes 68 and 70 are biased with DC voltage V1(DC) of about −50 volts and V2(DC) of about −100 volts, respectively. Therefore, the negatively charge toner particles 38 on the developer roller 30 repel against the first and second electrodes 68 and 70 and, therefore, stay on the developer roller 30 without propelling toward the apertures 56.

The controller 90 transmits the image data corresponding to the printing image to the drivers 72, 76 and 80. In response to the image data, the driver 72 supplies the first electrodes 68 at the central and upstream and downstream sides portions with the voltage V1(P) of about +300 volts. Simultaneously, the driver 76 provides the second electrode

70*b* at the central portion with the voltage V2b(P) of +200 volts, and the driver 80 provides the second electrodes 70*a* and 70*c* at the downstream and upstream portions with the higher voltage V2*ac*(P) of +250 volts.

As a result, the toner particles 38 born on the portions of the developer roller 30, confronting to the biased electrodes, are electrically attracted by the first and second electrodes 68 and 70. This energizes a number of toner particles 38 born on the portions to propel into the opposing apertures 56 under the existence of the attraction force formed between the developing roller 30 and the backing electrode 44.

Also, due to the voltage difference between V2*b*(P) and V2*ac*(P), i.e., 200 and 250 volts, substantially the same amount of toner particles are energized at the portions 30*a*, 30*b* and 30*c* and then propelled into the corresponding apertures 56*a*, 56*b* and 56*c*.

When the toner particles 38 have reached substantially midways of respective apertures 56, the pulse voltages V1(P), V2*b*(P) and V2*ac*(P) are turned off at respective timings. Then, the DC voltages V1(DC), V2(DC) of negative polarity are applied to the electrodes 68 and 70, respectively. Due to this, the negatively charged toner particles 38 propelling in the aperture 56 are forced radially, inwardly and then converged. The converged toner particles 38 are then deposited on the sheet 8 moving past the printing zone 54, thereby forming dots on the sheet 8. Thus, each dot made by the converged toner particles 38 has a high density and clear contour. Also, by turning off the pulses, further propelling of the toner particles from the developer roller 30 is prohibited.

The sheet 8 to which the toner particles 38 have been deposited is transported into the fusing station 18 where the toner particles 38 are fused and permanently fixed on the sheet 8 and, finally, fed out onto the final stack station or catch tray 20.

The printing device may be changed or modified in various ways. For example, in the previous embodiment, the pulse voltage V2*ac*(P) for the second electrodes 70*a* and 70*c* associated with the downstream and upstream side apertures 56*a* and 56*c*, respectively, is set to be larger than the pulse voltage V2*b*(P) for the second electrode 70*b* associated with the central aperture 56*b* to ensure that the same amount of toner particles are propelled into the central aperture 56*b* and the downstream and upstream side apertures 56*a* and 56*c*. Alternatively, duration of the pulse voltage V2*ac*(P) may be larger than that of the pulse voltage V2*b*(P), as shown in FIG. 8.

Further, although the peak voltage V1(P) is applied to the first electrodes 68 in the central portion and the downstream and upstream portions, for attaining the same purpose, the peak voltages V1b(P) for the electrode 68*b* may be different from the peak voltage V1*ac*(P) for the electrodes 68*a* and 68*c* (see FIG. 9), or the peak duration of the peak voltage V1*b*(P) may be different from that of the peak voltage V1*ac*(P) (see FIG. 10).

Figure 11:
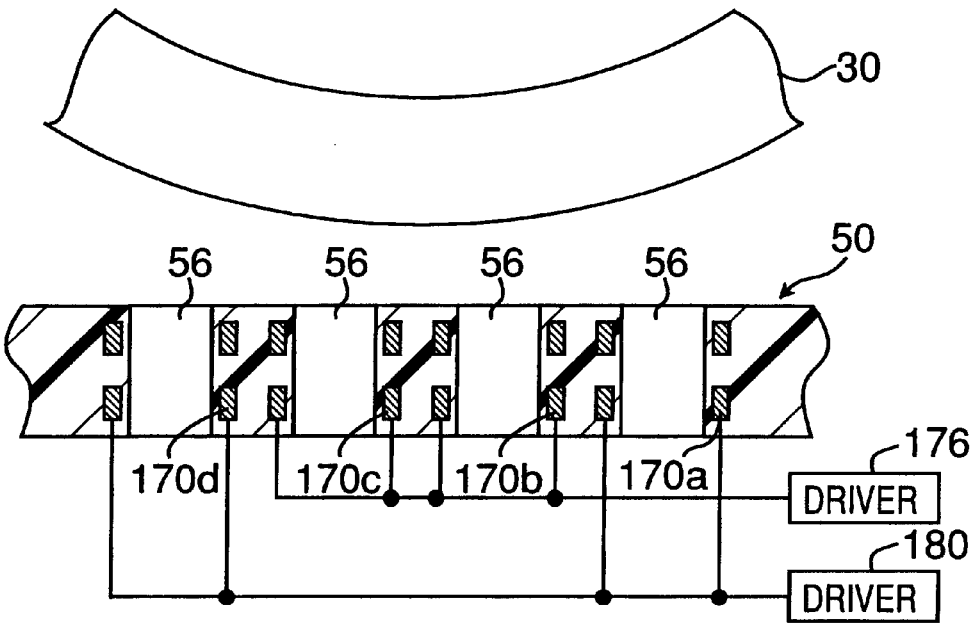
FIG. 11 is an enlarged fragmentary cross-sectional view of the printing head, developing roller and backing electrode, in which four rows of apertures are formed in the printing head.

Descriptions have been made to the embodiment in which the printing head has three rows of apertures, though, four or more rows of apertures may be provided for the printing head. For example, when the printing head includes four rows of apertures as shown in FIG. 11, second electrodes 170*b* and 170*c* of the second and third rows are communicated with a driver 176 and second electrodes 170*a* and 170*d* of the first and fourth rows are communicated with another driver 180 so that the second electrodes 170*a* and 170*d* in the first and fourth rows are applied with a pulse voltage which is higher in voltage or is longer in peak duration than that applied to the second electrodes 170*b* and 170*c* of the second and third rows.

Figure 12:
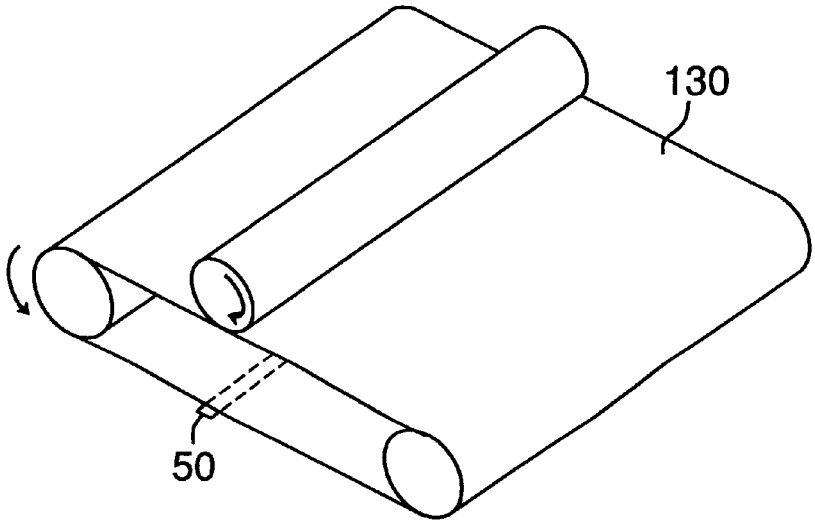
FIG. 12 is a perspective view of a bearing member.

It has been understood that when a number of apertures are formed along several lines each extending perpendicular to the sheet transporting direction, the amount of toner particles propelled into the apertures located on downstream side with respect to rotational direction of the toner bearing member (developing roller 30) can be lesser than that on upstream side. The reason may be that each of the incremental portions of the toner bearing member gradually loses toner particles while it moves past the printing zone. Such phenomenon equally occurs in printing devices that employ the cylindrical toner bearing member (see FIG. 2) and a belt type toner bearing member 130 (see FIG. 12). Therefore, the feature of the present invention can be applied to such devices, thereby ensuring that the same amount of toner particles can be propelled into each aperture.

The above-described approach can also be applied to correct an unwanted density difference in the resultant image with respect to a direction perpendicular to the sheet transporting direction. The density difference may occur when the toner bearing member is out of parallel to the printing head or when one longitudinal end portion of the toner bearing member bears less toner particles than the other longitudinal end portion.

Figure 13A:
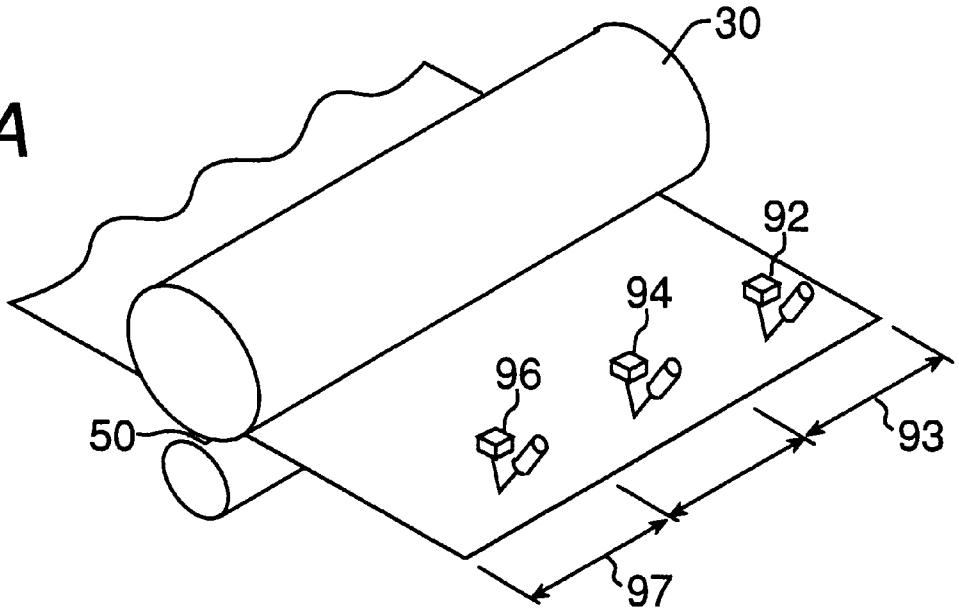
FIG. 13A is a partial perspective view of the printing device in which three optical sensors are included.
Figure 13B:
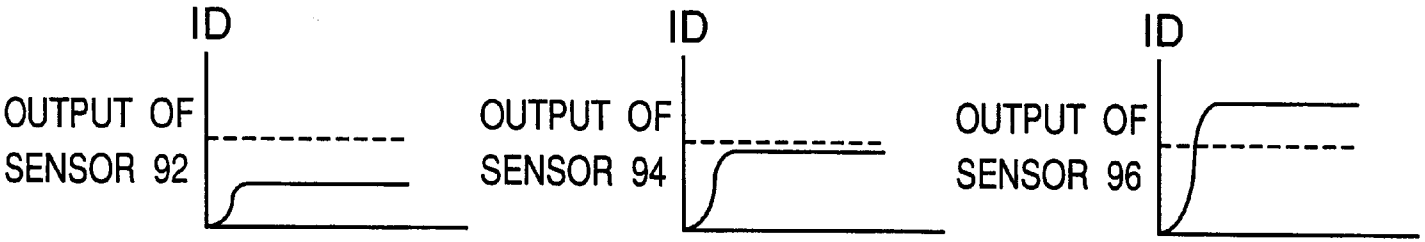
FIG. 13B graphs outputs of three optical sensors shown in FIG. 13A.

Specifically, in an embodiment shown in FIG. 13, three optical sensors 92, 94 and 96 are positioned so that the image densities of the printed image can be detected at three points, the center and opposite sides of the printed image. A controller not shown is communicated with the optical sensors so that it can receive the signals from the sensors and, then, determine the densities of the central and side portions of the resultant image. When the density difference is recognized from the outputs of the sensors as shown in FIG. 13B, higher voltage or longer duration is provided for the pulses of the image signal applied to the first (or second) electrode on one side where the image density has been found to be lower than a reference density while lower voltage or shorter duration is provided for the second (or first) electrode in the opposite side where the image density has been found to be higher than the reference density.

Only for controlling the whole density of image only, one optical sensor may be sufficient. In this instance, the optical sensor is arranged to confront the printed image on the sheet for detecting the image density. With the output of the sensor, the pulse level and/or pulse duration of the image signal is controlled to increase or decrease the density of the printed image.

Further, it may be envisioned that, where the printing device has a plurality rows of apertures in the printing head, a test pattern is printed for each aperture row and, then, based upon printed image density, the pulse level and/or pulse duration applied to the electrode of the aperture row is controlled.

Figure 14:
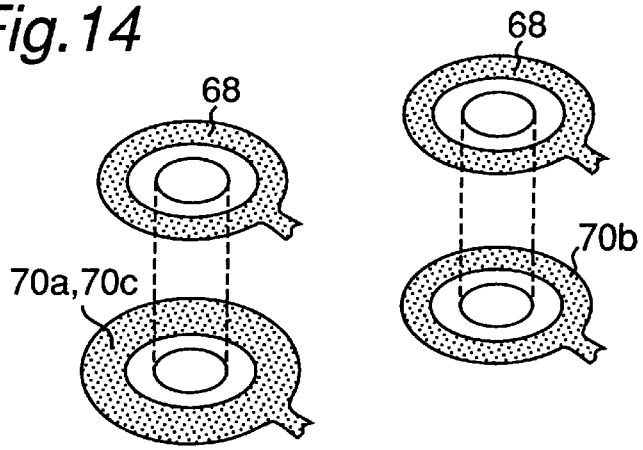
FIG. 14 is a perspective view of the electrodes in which a width of second electrodes in a certain row is different from that of another second electrodes in another row.
Figure 15:
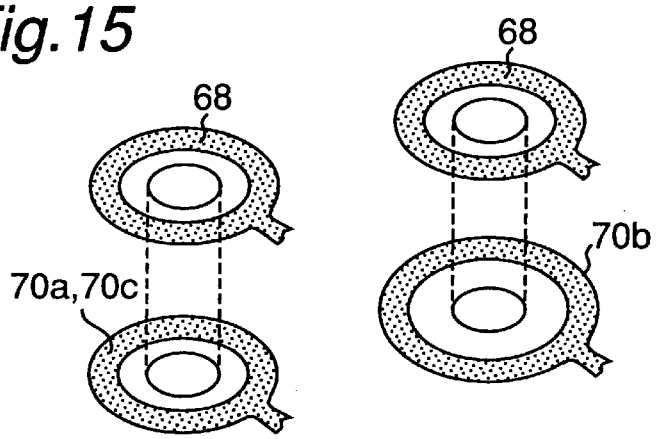
FIG. 15 is a perspective view of the electrodes in which an inner diameter of second electrodes in a certain row is different from that of another second electrodes in another row.
Figure 16:
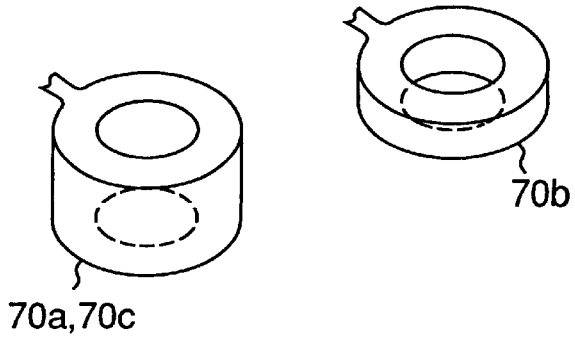
FIG. 16 is a perspective view of the electrodes in which a thickness of second electrodes in a certain row is different from that of another second electrodes in another row.
Figure 17A:
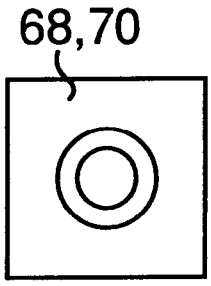
FIGS. 17A to 17F shows another configurations of the electrode.
Figure 17B:
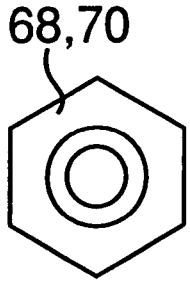
Figure 17C:
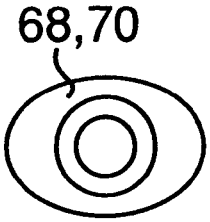
Figure 17D:
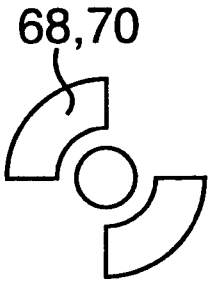
Figure 17E:
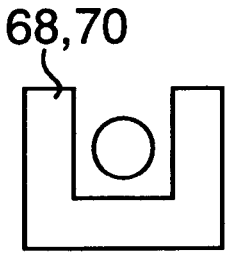
Figure 17F:
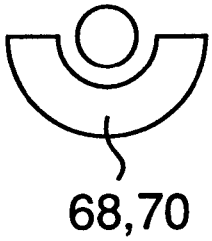

The first and/or second electrode may be sized according the distance between the toner bearing member and the corresponding aperture. For example, as shown in FIGS. 14 and 15, a width, an inner diameter, or both of the first and second electrodes, 70*a* and 70*b*, for the upstream and downstream sides may be designed to be larger than that of the central electrode. In addition, as shown in FIG. 16, the thickness of the electrode 70*b* may be different from that of the electrodes 70*a* and 70*c*.

Further, the configuration of the electrodes is not limited to the annular ring, it may be other configurations as shown in FIGS. 17A to 17F.

Furthermore, although each row of apertures is arranged in a certain direction perpendicular to the sheet transporting direction in the above-described embodiment, the orientation of the row may be angled or inclined against the certain direction.

Moreover, although a plurality rows of apertures are formed in the printing head 3 in the above-described embodiment, the present invention is not limited thereto and a direct printing device in which the printing head includes a single row of apertures falls within the scope of the present invention.

As various changes could be made in the above construction, it is intended all matter contained in the above description or shown in the accompanying drawings shall be interpreted as illustrative and not in a limiting sense.

What is claimed is:

1. A direct printing apparatus for depositing printing particles onto a sheet substrate, comprising:

(a) a bearing member which bears said printing particles thereon, said printing particles being electrically charged to a certain polarity;

(b) a backing electrode which opposes to said bearing member;

(c) a power supply which generates an electric field that attracts said charged printing particles born on said bearing member toward said backing electrode;

(d) a printing head which interposes between said bearing member and said backing electrode to cooperate with said backing electrode to form a passage therebetween through which said sheet substrate can pass, said printing head including an electrically insulative sheet member having a plurality of apertures arranged in one or more lines through each of said aperture said printing particles can propel, and a plurality pairs of first and second electrodes, each pair of first and second electrodes being arranged adjacent to said aperture; and (e) a driver which applies said pair of first and second electrodes with first and second pulsating signals, respectively, thereby energizing said printing particles born on said bearing member to propel into associated aperture;

wherein a voltage level and/or a duration of said second pulsating signal to be applied to said second electrode is determined by a distance between said aperture adjacent to which said second electrode is arranged and an associated portion of said bearing member that opposes to said aperture.

2. A direct printing apparatus in accordance with claim 1, wherein said first electrode is located on one side, adjacent to said bearing member, of said printing head and said second electrode is located on the other side, adjacent to said backing electrode, of said printing head.

3. A direct printing apparatus for depositing printing particles onto a sheet substrate, comprising:

(a) a bearing member which bears said printing particles thereon, said printing particles being electrically charged to a certain polarity;

(b) a backing electrode which opposes to said bearing member;

(c) a power supply which generates an electric field that attracts said charged printing particles born on said bearing member toward said backing electrode; and (d) a printing head which interposes between said bearing member and said backing electrode to cooperate with said backing electrode form a passage therebetween through which said sheet substrate can pass, said printing head including an electrically insulative sheet member having a plurality of apertures arranged in one or more lines through each of said aperture said printing particles can propel, and a plurality of electrodes, each of said electrode being arranged adjacent to said aperture and being sized according to a distance between said aperture adjacent to which said electrode is arranged and an associated portion of said bearing member that opposes to said aperture.

4. A direct printing apparatus for depositing printing particles onto a sheet substrate, comprising:

(a) a bearing member which bears said printing particles thereon, said printing particles being electrically charged to a certain polarity;

(b) a backing electrode which opposes to said bearing member;

(c) a power supply which generates an electric field that attracts said charged printing particles born on said bearing member toward said backing electrode; and (d) a printing head which interposes between said bearing member and said backing electrode to cooperate with said backing electrode to form a passage therebetween through which said sheet substrate can pass, said printing head including an electrically insulative sheet member having a plurality of apertures arranged in one or more lines through each of said aperture said printing particles can propel, and a plurality electrodes, each of said electrode being arranged adjacent to said aperture with leaving a gap from said aperture, said gap being determined according to a distance between said aperture adjacent to which said electrode is arranged and an associated portion of said bearing member that opposes to said aperture.

* * * * *

UNITED STATES PATENT AND TRADEMARK OFFICE

CERTIFICATE OF CORRECTION

PATENT NO. : 6,227,656 B1
DATED : May 8, 2001
INVENTOR(S) : Yoshifumi Shibata et al.

It is certified that error appears in the above-identified patent and that said Letters Patent is hereby corrected as shown below:

Title page,
Item [73], add -- Array Printers AB, Vastra Frolunda, (Sweden) --

Signed and Sealed this

Twenty-third Day of April, 2002

*Attest:*

*Attesting Officer*

JAMES E. ROGAN
*Director of the United States Patent and Trademark Office*